US005349513A

United States Patent [19]

Taylor, III

[11] Patent Number: 5,349,513

[45] Date of Patent: Sep. 20, 1994

[54] LIGHT FIXTURE

[76] Inventor: William N. Taylor, III, 1201 Shady Creek Dr., Euless, Tex. 76040

[21] Appl. No.: 142,186

[22] Filed: Oct. 26, 1993

[51] Int. Cl.[5] ..... F21S 1/04

[52] U.S. Cl. ..... 362/404; 362/147; 362/406; 416/5

[58] Field of Search ..... 362/147, 404, 405, 406; 416/5

[56] References Cited

U.S. PATENT DOCUMENTS

| | | | |
|---|---|---|---|
| 1,115,479 | 11/1914 | Ayers et al. | 416/5 |
| 3,033,049 | 5/1962 | Morrow | 416/5 |
| 4,548,554 | 10/1985 | Angott | 416/5 |
| 4,626,970 | 12/1986 | Huang | 362/147 |
| 4,809,142 | 2/1989 | Auerbach | 362/147 |

*Primary Examiner*—Carroll B. Dority
*Attorney, Agent, or Firm*—W. Kirk McCord

[57] ABSTRACT

A ceiling-mountable light fixture adaptable for stand-alone use or use in connection with a ceiling fan is described. The fixture is mountable directly to a ceiling-mounted electrical junction box. The fixture is adapted to receive a suspension member, whereby a conventional ceiling fan may be suspended below the fixture, such that the fixture is positioned between the fan blades and the ceiling. The fixture is preferably pan-shaped, with a relatively flat base and an octagonal wall depending from the base. A distal portion of the wall is turned outwardly to define a flange which is positioned in facing contact with the ceiling when the fixture is mounted thereon. The fixture includes a central boss, which is elevated with respect to the base on a top side of the fixture, to define a recess on a bottom side thereof. The boss has a circular opening extending therethrough and an annular surface surrounding the opening. Eight rectangular notches communicate with the opening at respective selected positions around the circumference thereof. The notches are adapted to receive a mounting member, such as a screw, for mounting the fixture with the junction box. Portions of the annular surface are punched out to define feet projections, which engage the ceiling to provide a spacing between the ceiling and the central boss to accommodate electrical wiring.

14 Claims, 6 Drawing Sheets

LIGHT FIXTURE

FIELD OF THE INVENTION

This invention relates generally to light fixtures and in particular to an improved ceiling-mountable light fixture adapted for stand-alone use or use in connection with a ceiling fan.

BACKGROUND ART

Ceiling-mountable light fixtures of various types are known in the art. Typically, the light fixture is attached to an electrical junction box in the ceiling, whereby electrical power is supplied to one or more electric light bulbs mounted on the fixture.

Other types of light fixtures are adapted for mounting with the hub of a ceiling fan at a base thereof such that the light fixture is located below the fan blades. A ceiling-mountable light fixture adaptable for stand-alone use or use in connection with a ceiling fan heretofore has not been known.

DISCLOSURE OF INVENTION

In accordance with the present invention, a light fixture is provided which is adaptable for stand-alone use or alternatively for use in connection with a conventional ceiling fan. The fixture is comprised of a pan-shaped member and at least one light bulb receiving socket mounted with the pan-shaped member. The pan-shaped member has a base and a wall depending from the base around substantially the entire perimeter thereof. The fixture further includes a central boss, which is elevated with respect to the base. The boss has a central opening and a plurality of notches communicating with the central opening, each of the notches being adapted to receive a mounting member, whereby the fixture is mountable with a ceiling or other support surface.

In one embodiment, the central opening is substantially circular and the notches are spaced at predetermined angular intervals around the circumference of the central opening such that each of the notches is in diametrically opposed relationship with another one of the notches to define a cooperating pair of notches. The notches of each cooperating pair are alignable with respective mounting tabs of a ceiling-mounted electrical junction box for receiving respective mounting members, whereby the fixture is mounted with the junction box.

In accordance with one feature of the invention, the fixture includes a plurality of feet projecting from the surface surrounding the central opening. The feet are engageable with the ceiling or other support surface to provide a space between the fixture and the ceiling or other support surface for electrical wiring. The feet are preferably formed by punching out portions of the surface at selected locations to define a corresponding plurality of openings in the surface. Each opening is located between adjacent ones of the notches such that each opening is in diametrically opposed relationship with another one of the openings. In accordance with another feature of the invention, a distal portion of the wall is turned outwardly around substantially the entire perimeter of the wall to define a flange which is positionable in facing contact with the ceiling or other support surface when the fixture is mounted on the ceiling or other support surface.

The light fixture is preferably mounted on a ceiling or other support surface by means of a plate member having a plurality of arcuate slots. Each of the slots is in diametrically opposed relationship with another one of the slots to define a cooperating pair of slots. The slots of each cooperating pair are alignable with the respective notches of a selected cooperating pair of notches for receiving respective mounting members. The mounting members are engageable with the respective mounting tabs of the electrical junction box for mounting both the light fixture and the plate member with the junction box, with the light fixture being positioned between the ceiling and the plate member. The plate member further includes opposed first and second holes.

If it is desired to suspend a ceiling fan below the light fixture, a suspension member is provided. The suspension member has opposed first and second apertures and opposed third and fourth holes. The suspension member is adapted to receive a ceiling fan downrod for suspending a ceiling fan below the fixture. The first and second apertures are alignable with the respective first and second holes in the plate member for receiving respective first and second attachment members, whereby the suspension member is attached to the plate member. The suspension member further includes a downrod receiving opening and a tongue projection extending into the opening. A distal end of the downrod is defined by a substantially hemispherical knob with an elongated groove formed therein. The tongue projection is matingly engageable with the groove when the downrod is received within the downrod receiving opening in the suspension member. The mating engagement between the groove and tongue projection secures the downrod against rotation within the suspension member. The suspension member further includes a seating surface for journally supporting the knob, whereby the downrod and ceiling fan are suspended below the light fixture.

A cover member having opposed third and fourth apertures is positioned to envelope the suspension member with the third and fourth apertures aligned with the respective third and fourth holes in the suspension member for receiving respective third and fourth attachment members, whereby the cover member is attached to the suspension member.

BEST MODE FOR CARRYING OUT THE INVENTION

Figure 1:
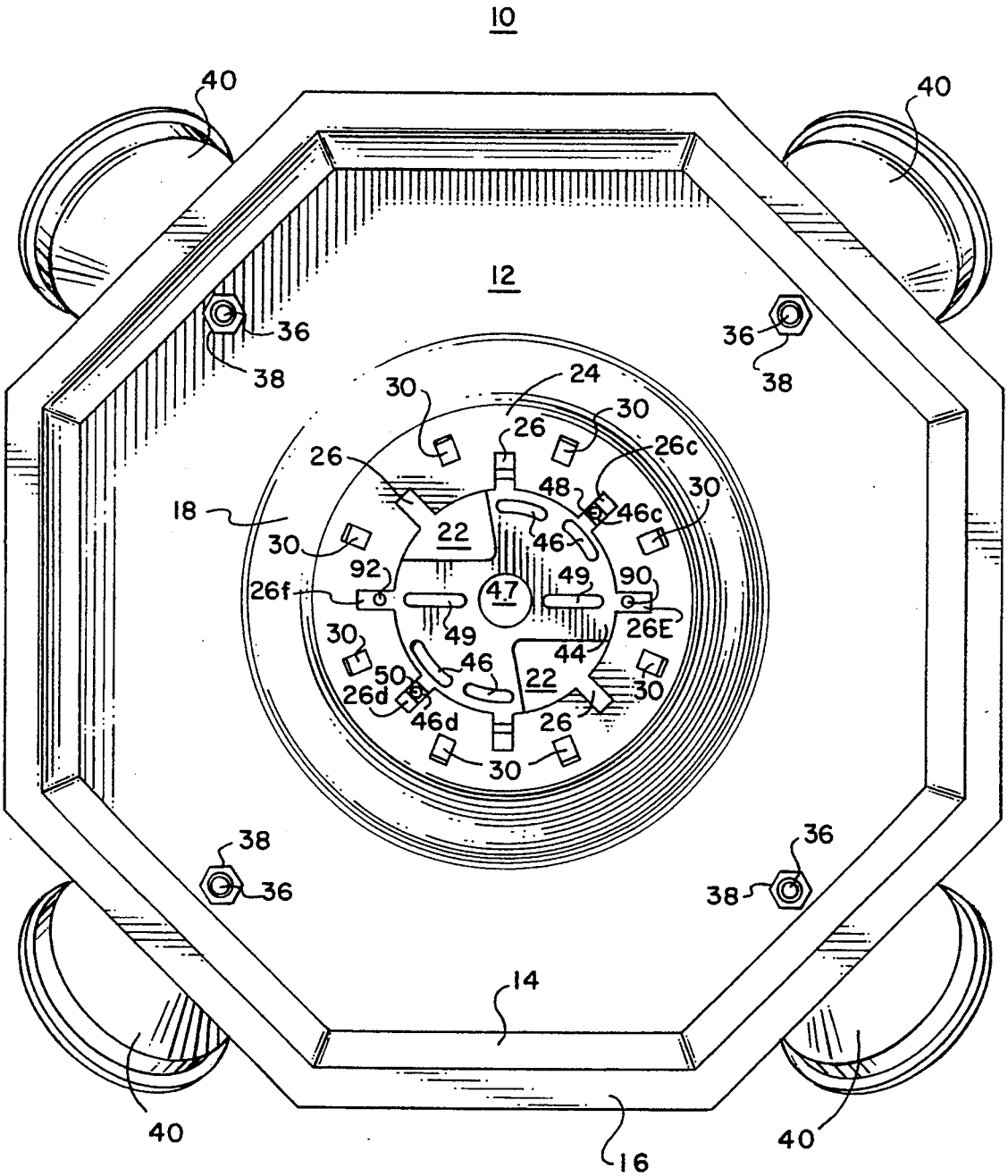
FIG. 1 is a top plan view of a ceiling-mountable light fixture, according to the present invention.

The best mode for carrying out the invention will now be described in detail with reference to the accompanying drawings. The drawings are not necessarily to scale and in some instances proportions may have been exaggerated in order to more clearly depict certain features of the invention. Like parts are marked throughout the specification and drawings with the same respective reference numbers.

Referring to FIGS. 1–5, a light fixture 10 is generally pan-shaped, with a relatively flat base 12 and an octagonal wall 14 extending upwardly from base 12. Although an octagonal-shaped wall 14 is shown, the light fixture 10 may have a wall of any desired shape. A distal portion of wall 14 is turned outwardly to define a flange 16. Fixture 10 is preferably made of a metal material such as steel or brass.

Fixture 10 includes a central boss 18, which is elevated with respect to base 12 on a top side of fixture 10 to define a recess 20 on a bottom side of fixture 10. Boss 18 has a substantially circular central opening 22 extending therethrough and an annular surface 24 surrounding central opening 22. Annular surface 24 is in substantially parallel relationship with base 12. Central opening 22 defines the approximate geometric center of fixture 10.

Eight rectangular notches 26 communicate with central opening 22 at respective selected positions around the perimeter of central opening 22. Notches 26 are spaced at predetermined angular intervals of approximately 45°. The spacing of notches 26 is such that each notch 26 is in diametrically opposed relationship with one of the other seven notches 26. Portions of annular surface 24 are punched out at respective selected positions between adjacent ones of notches 26, to define eight corresponding feet projections 28. The formation of feet projections 28 defines eight rectangular openings 30 in annular surface 24.

Fixture 10 has four light bulb receiving sockets 32 mounted on respective distal ends of four mounting arms 34. Arms 34 are secured to base 12 by respective threaded bolts 36 and complementary threaded nuts 38. Each socket 32 is received within a protective cover 40, which substantially envelopes the corresponding socket 32. Covers 40 are preferably decorative covers made of a metal material such as steel or brass. Each cover 40 and the corresponding socket 32 are preferably connected to the corresponding mounting arm 34 by means of a swivel connection indicated generally at 42 in FIG. 4, whereby each socket 32 is swivelable with respect to the corresponding mounting arm 34 and fixture 10. The swivel connections allow the respective positions of the individual light bulbs (not shown) mounted in the respective sockets 32 to be adjusted to vary the direction of the light emanating from fixture 10.

Figure 4:
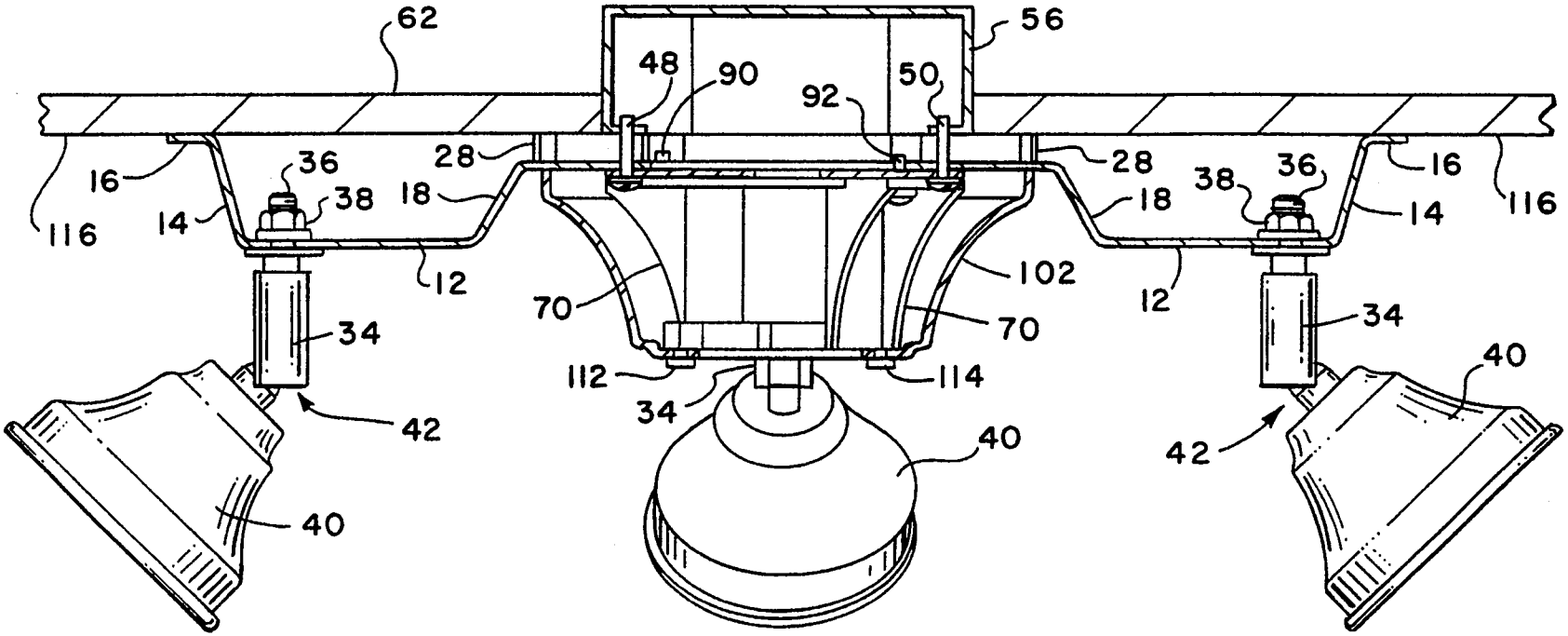
FIG. 4 is an elevational view of the light fixture of FIG. 1, showing the light fixture mounted on a ceiling.

A plate member 44 is provided for mounting fixture 10 on a ceiling or other support surface. Plate member 44 is generally circular with two wedge-shaped portions removed, as indicated generally at 45. Plate member 44 has a plurality of arcuate slots 46*a* central opening 47 and two aligned slots 49. Each slot 46 is in diametrically opposed relationship with a particular one of the other slots 46. Plate member 44 is positionable in recess 20 with two diametrically opposed slots 46 in alignment with two diametrically opposed notches 26, respectively, for receiving attachment screws 48 and 50, respectively. In the example shown in FIG. 3, slot 46*a* is positioned in alignment with notch 26*a* and slot 46*b* is positioned in alignment with notch 26*b*. Attachment screw 48 is passed through slot 46*a* and notch 26*a* and attachment screw 50 is passed through slot 46*b* and notch 26*b*. After penetrating through notch 26*a*, screw 48 engages a complementary threaded opening 52 in a tab 54 of a generally rectangular ceiling-mounted electrical junction box 56. Similarly, after penetrating through notch 26*b*, screw 50 engages a complementary threaded opening 58 in a tab 60 of junction box 56. Tab 60 is in diagonally opposed relationship with tab 54. The threaded engagement between attachment screws 48 and 50 and the respective tabs 54 and 60 secures light fixture 10 and plate member 44 to a support surface, such as a ceiling 62, as shown in FIG. 4. Junction box 56 is preferably relatively permanently mounted above ceiling 62 such that tabs 54 and 60 are substantially coincident with ceiling 62.

Plate member 44 is rotatable within recess 20 about an axis perpendicular to a major surface 64 of plate member 44, such that any two diametrically opposed slots 46 are respectively positionable in alignment with any two diametrically opposed notches 26. Plate member 44 further includes diametrically opposed holes 66 and 68, which are respectively positionable in alignment with another diametrically opposed pair of notches 26. In the example shown in FIG. 1, slot 46*c* is in alignment with notch 26*c*, with attachment screw 48 extending therethrough, and slot 46*d* is in alignment with notch 26*d*, with attachment screw 50 extending therethrough. Hole 66 is in alignment with notch 26*e* and hole 68 is in alignment with notch 26*f*.

A suspension member 70 is provided for suspending a conventional ceiling fan below fixture 10. Suspension member 70 has opposed elongated apertures 72 and 74 in a top part 76 of member 70 and diametrically opposed holes 78 and 80 in a generally horseshoe-shaped bottom part 82 of member 70. Bottom part 82 has a generally circular opening 84 with a tongue projection 86 extending into opening 84. Bottom part 82 also includes a seating surface 88 extending substantially around the entire perimeter of bottom part 82.

Suspension member 70 is positionable with aperture 72 in alignment with hole 66 and aperture 74 in alignment with hole 68, for receiving respective threaded attachment screws 90 and 92, whereby suspension member 70 is secured to plate member 44. The respective distal ends of screws 90 and 92 are received in notches 26*e* and 26*f*, respectively (FIG. 1), after screws 90 and 92 are passed through aperture 72 and hole 66 and through aperture 74 and hole 68, respectively. Holes 66 and 68 have female threads which are complementary with the male threads of screws 90 and 92.

Figure 5:
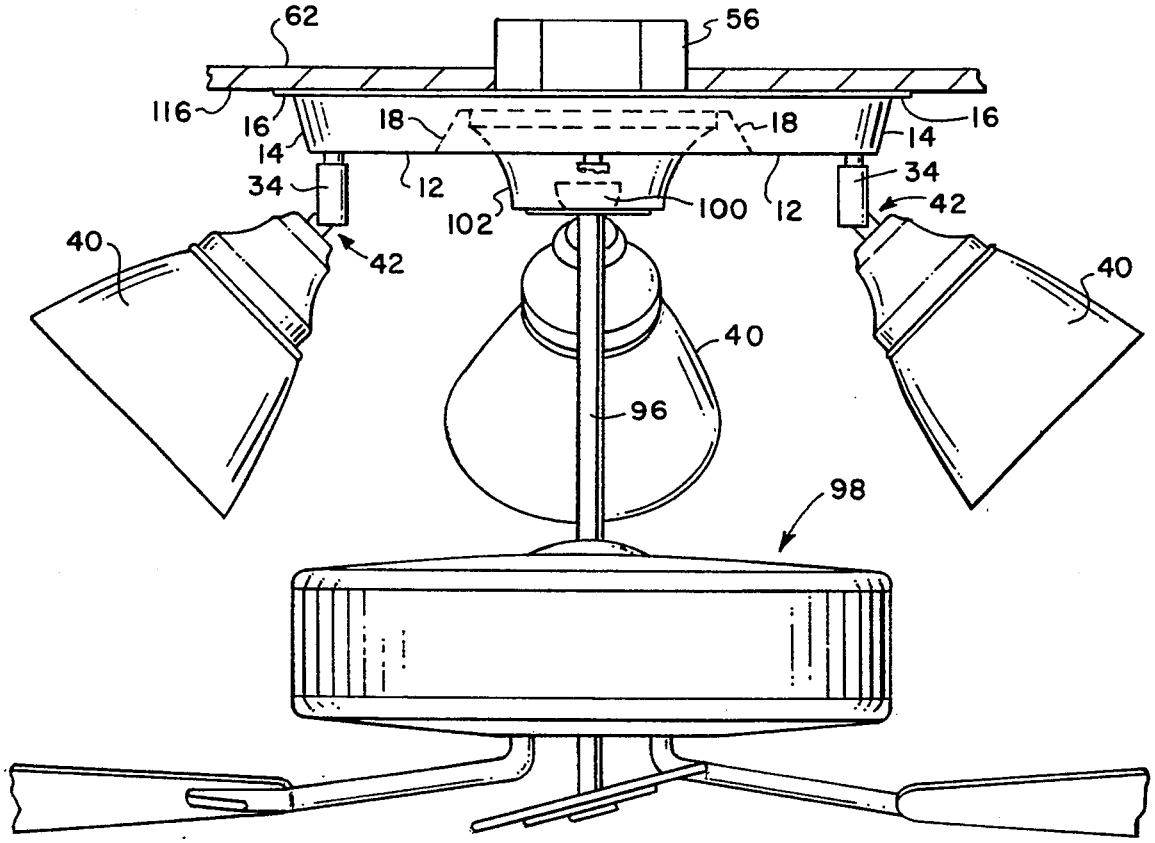
FIG. 5 is an elevational view of the light fixture of FIG. 1, showing the light fixture mounted on a ceiling above a conventional ceiling fan.

A portion of bottom part 82 is cut out, as indicated generally at 94, to accommodate insertion of substantially cylindrical downrod 96 attached to a conventional ceiling fan 98. A distal end of downrod 96 is enlarged to define a generally hemispherical knob 100 (FIG. 5). Knob 100 is journally supported by seating surface 88. Although not shown in the drawings, knob 100 has an elongated groove for matingly receiving tongue projection 86 to secure knob 100 and downrod 96 against rotation within suspension member 70. Suspension member 70 therefore serves to suspend fan 98 and downrod 96 beneath fixture 10, as shown in FIG. 5.

A cover member 102 is positionable within recess 20 to substantially completely envelope plate member 44 and suspension member 70. Cover member 102 has a generally circular bottom opening 104 through which downrod 96 extends, as can be best seen in FIG. 5. Cover member 102 has diametrically opposed apertures 106 and 108 in an annular surface 110 surrounding opening 104. Apertures 106 and 108 are positionable in alignment with the respective holes 78 and 80 for receiving respective threaded attachment screws 112 and 114, whereby cover member 102 is secured to suspension member 70. Holes 78 and 80 have female threads which are complementary with male threads on attachment screws 112 and 114. As can be best seen in FIG. 2, respective first portions 106*a* and 108*a* of apertures 106 and 108 are enlarged relative to respective second portions 106*b* and 108*b* of apertures 106 and 108 for receiving respective head portions 112*a* and 114*a* of attachment screws 112 and 114. Cover member 104 is rotatable to position respective shaft portions 112*b* and 114*b* of screws 112 and 114 within respective second portions 106*b* and 108*b*. Screws 112 and 114 are then tightened to secure cover member 102 to suspension member 70.

Figure 2:
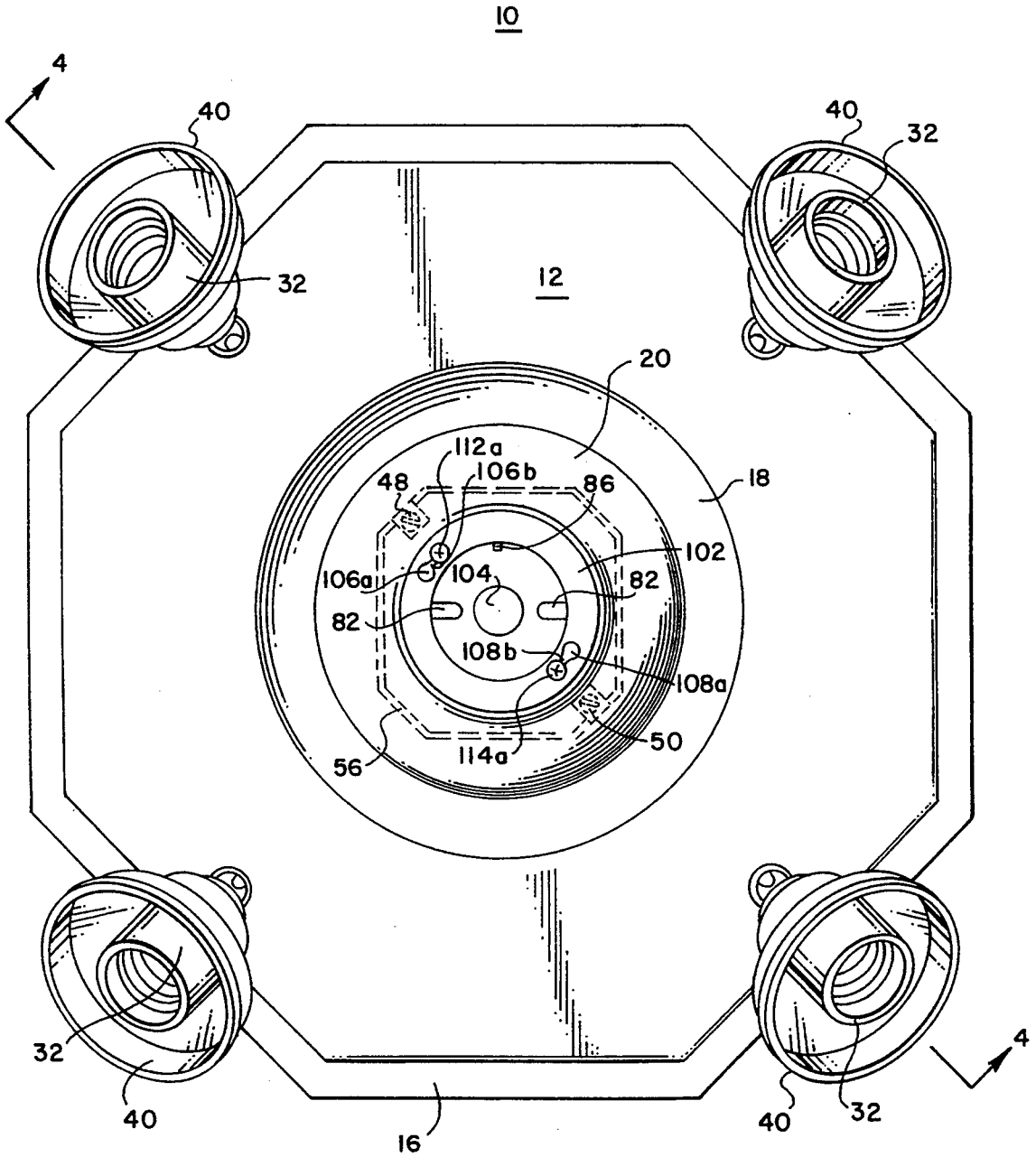
FIG. 2 is a bottom plan view of the light fixture of FIG. 1.
Figure 3:
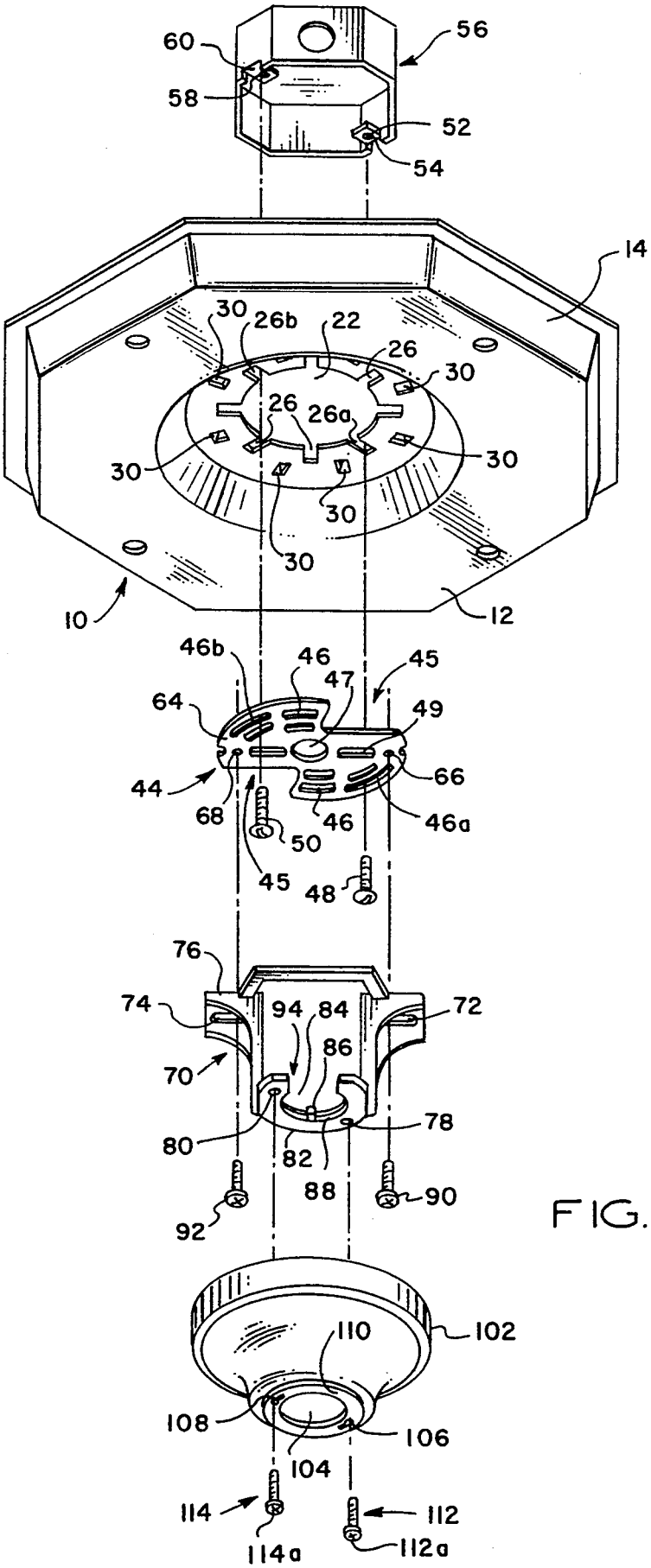
FIG. 3 is an exploded view of the light fixture of FIG. 1.

Referring to FIG. 4, when light fixture 10 is mounted on a ceiling 62 or other support surface, flange 16 is in facing contact with a downwardly facing surface 116 of ceiling 62. Feet projections 28 contact surface 116 to provide a space between annular surface 24 of central boss 18 and ceiling 62. The space is required to accommodate electrical wiring (not shown) between junction box 56 and the individual light sockets 32 (FIG. 2). Electrical connections between fixture 10 and junction box 56 should always be made by a qualified electrician.

Light fixture 10 may also be used as stand-alone fixture. In that event, suspension member 70 is not used. Rather, a cover member (not shown) having a smaller bottom opening than bottom opening 104 in cover member 102 is attached by means of screws (not shown) directly to plate member 44. The smaller bottom opening has sufficient diameter to accommodate a light switch pull chain (not shown).

The procedure by which light fixture 10 is mounted is as follows. Plate member 44 is attached to one of the tabs 54, 60 of junction box 56 (e.g., tab 54) by passing one of the attachment screws 48, 50 (e.g. screw 48) through one of the arcuate slots 46 and screwing screw 48 into tab 54. Initially, screw 48 should not be screwed in all the way so that plate member 44 hangs loosely below junction box 56. Light fixture 10 is then slid along ceiling surface 116 towards junction box 56 and plate member 44. Plate member 44 is then passed through central opening 22 so that annular surface 24 is positioned between plate member 44 and junction box 56. Fixture 10 is then adjusted to position central opening 22 in the approximate geometric center of junction box 56 with screw 48, which is holding plate member 44 to junction box 56, being positioned in one of the eight notches 26. When fixture 10 is properly positioned, it will hang between junction box 56 and plate member 44, allowing the installer the use of both hands to complete the mounting process.

The position of fixture 10 is adjusted so that the other tab 60 is aligned with a notch 26 which is diametrically opposed from the notch 26 in which screw 48 is positioned. Screw 50 is then inserted through the arcuate slot 46 and the diametrically opposed notch 26 which is in alignment with tab 60. Before tightening attachment screws 48 and 50, the electrical wires to be attached to the ceiling fan should be hanging down through central opening 22. Screws 48 and 50 are then tightened to securely attach plate member 44 and fixture 10 to junction box 56. There should three notches 26 between attachment screws 48 and 50 in either direction. The eight notches 26 are configured so that any two diametrically opposed notches can be added to mount fixture 10, depending upon the desired position of fixture 10 in relation to the walls of the room in which fixture 10 is installed.

Once fixture 10 and plate member 44 are properly secured, it is a relatively straight forward procedure to attach suspension member 70 (if required) and cover member 102 in the manner described hereinabove.

Figure 6:
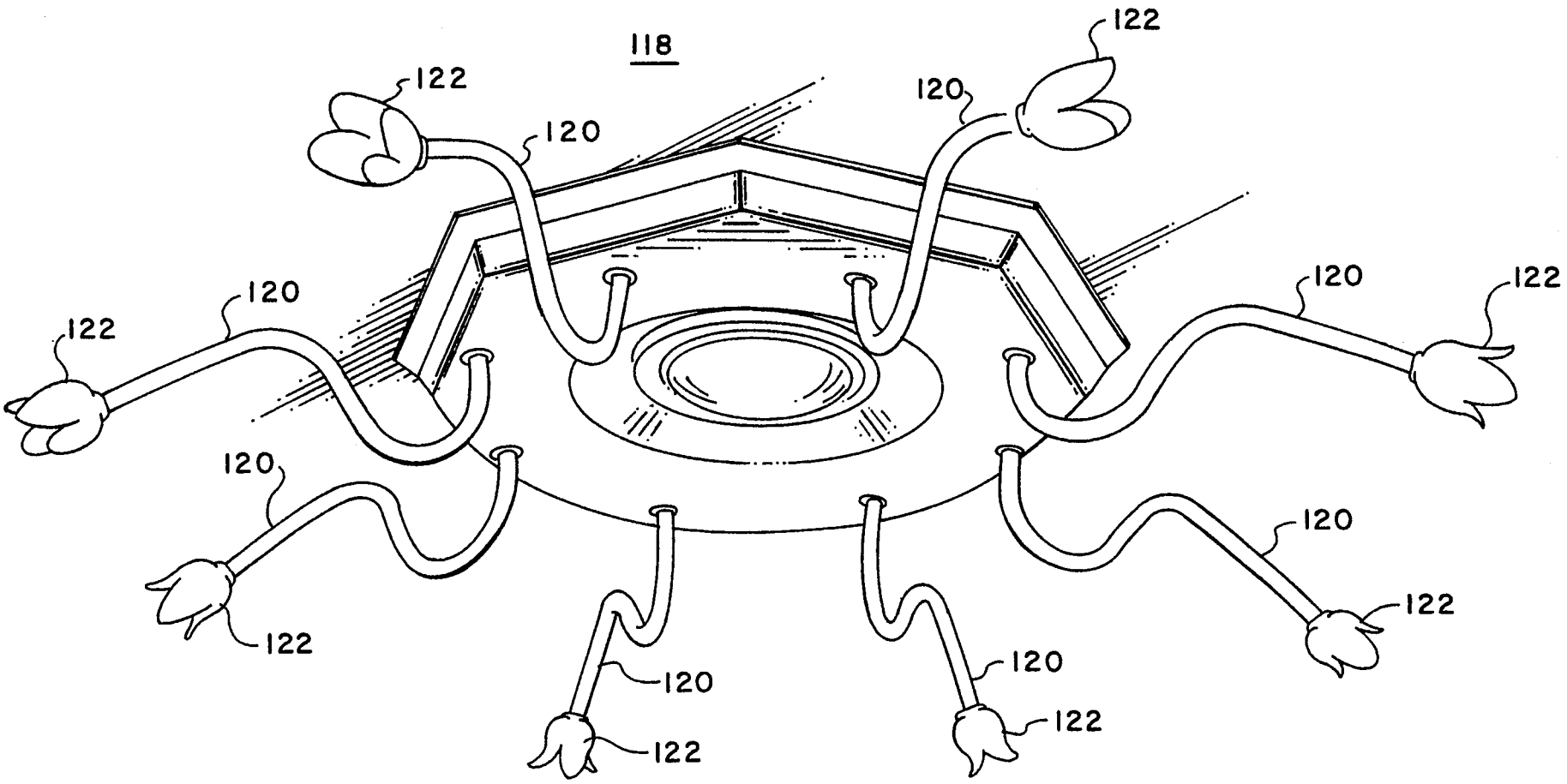
FIG. 6 is a perspective view of an alternate embodiment of a ceiling-mounted light fixture, according to the present invention.

Referring to FIG. 6, an alternate embodiment of a light fixture 118, according to the present invention, is depicted. Fixture 118 is similar to fixture 10, described above with reference to FIGS. 1–5, except that fixture 118 has a plurality of serpentine arms 120 mounted thereon. Located at the distal end of each arm 120 is a light socket (not shown) substantially enveloped by a decorative cover 122. In FIG. 6, covers 122 are tulip-shaped.

The light fixture according to the present invention has the capability of being used as a stand-alone ceiling light fixture or alternatively as a ceiling fan light fixture mounted above the fan blades. Mounting the light fixture above the fan blades has the advantage of allowing the fixture to be mounted higher than conventional ceiling fan light fixtures. This is particularly advantageous when the ceiling fan is suspended below a relatively low ceiling. Mounting the light fixture between the ceiling and fan makes damage to the light fixture less likely. In particular the decorative socket covers are better protected. Positioning the lights above the ceiling fan also provides a different lighting effect in the room. The light fixture according to the present invention may also be mounted above a ceiling fan with its own light fixture beneath the fan, to provide yet another different lighting effect.

Various embodiments of the invention have been described in detail hereinabove. Since it is obvious that many additions to or changes in the above-described preferred embodiments may be made without departing from the nature, spirit and scope of the invention, the invention is not to be limited to the details described hereinabove.

What is claimed is:

1. A light fixture comprising a pan-shaped member and at least one light bulb receiving socket mounted with said pan-shaped member, said pan-shaped member having a base and a wall extending upwardly from said base around said substantially the entire perimeter thereof, said light fixture including a central boss elevated above said base and inward of said wall on one side of said fixture to define a recess on an opposite side of said fixture, said boss having an opening and a plurality of notches communicating with said opening, each of said notches being adapted to receive a mounting member, whereby said fixture is mountable with a ceiling or other support surface.

2. The fixture of claim 1 wherein said opening is substantially circular and said notches are spaced at predetermined angular intervals around said opening, such that each of said notches is in diametrically opposed relationship with another one of said notches to define a plurality of diametrically opposed cooperating pairs of notches, each cooperating pair being alignable with respective mounting tabs of a ceiling-mounted electrical junction box for receiving first and second mounting members, whereby said fixture is mountable with the junction box.

3. The fixture of claim 2 further including a plate member having first and second diametrically opposed arcuate slots, said slots being alignable with the respective notches of a selected one of the cooperating pairs of notches and with the respective mounting tabs of the junction box for receiving the respective first and second mounting members, whereby said fixture is mountable with the junction box.

4. The fixture of claim 1 further including a plurality of feet projecting from said boss, said feet being engageable with the ceiling or other support surface to provide a space for electrical wiring between said fixture and the ceiling or other support surface.

5. The fixture of claim 4 wherein said feet are formed by punching out selected portions of said boss to define a corresponding plurality of holes in said annular surface.

6. The fixture of claim 1 wherein a distal portion of said wall is turned outwardly around substantially the entire perimeter of said wall, to define a flange which is positionable in facing contact with the ceiling or other support surface.

7. The fixture of claim 1 wherein said wall has an octagonal shape.

8. The fixture of claim 1 wherein said fixture has a plurality of light bulb receiving sockets and a corresponding plurality of mounting arms for mounting the respective sockets with said fixture.

9. The fixture of claim 8 wherein said sockets are swivelably mountable with said pan-shaped member.

10. In combination:

a light fixture comprising a pan-shaped member and at least one light bulb receiving socket mounted with said pan-shaped member, said pan-shaped member having a base and a wall extending upwardly from said base around substantially the entire perimeter thereof, said fixture further including a central boss elevated above said base and inward of said wall on one side of said fixture to define a recess on an opposite side of said fixture, said boss having an opening and opposed first and second notches communicating with said opening, said notches being alignable with respective first and second mounting tabs of a ceiling-mounted electrical junction box; a plate member having opposed first and second arcuate slots and opposed first and second holes, said first and second slots being aligned with the respective first and second notches;

first and second mounting members, said first mounting member extending through the aligned first slot and first notch for engaging the first mounting tab, said second mounting member extending through the aligned second slot and second notch for engaging the second mounting tab, whereby said fixture is mountable with a ceiling;

a suspension member having opposed first and second apertures aligned with the respective first and second holes, said suspension member being adapted to receive a ceiling fan downrod for suspending a ceiling fan below said light fixture; and first and second attachment members, said first attachment member extending through the aligned first aperture and first hole, said second attachment member extending through the aligned second aperture and second hole for attaching said suspension member to said plate member.

11. The combination of claim 10 further including a ceiling fan and a downrod extending from the fan, a distal end of said downrod being defined by a substantially hemispherical knob with a groove formed therein, said suspension member having a downrod receiving opening and a tongue projection extending into said opening for matingly engaging said groove, said suspension member further including a support surface for journally supporting said knob, whereby said fan is suspended below said light fixture by said suspension member.

12. The combination of claim 11 wherein said suspension member has opposed third and fourth holes, said combination further including a cover member having opposed third and fourth apertures, said cover member being positioned to envelope said suspension member with said third and fourth holes aligned with the respective third and fourth apertures, said combination further including a third attachment member extending through the aligned third aperture and third hole and a fourth attachment member extending through the aligned fourth aperture and fourth hole for attaching said cover member to said suspension member.

13. The combination of claim 12 wherein said opening is substantially circular and said boss has a plurality of notches spaced at predetermined angular intervals around said opening and communicating therewith, each of said notches being in diametrically opposed relationship with another one of said notches to define a plurality of diametrically opposed cooperating pairs of notches, the notches of each cooperating pair being alignable with the respective first and second mounting tabs, said first and second mounting members extending through the notches of a first cooperating pair of notches, said first and second attachment members extending through the notches of a second cooperating pair of notches.

14. The combination of claim 13 wherein said first and second mounting members and said first, second, third and fourth attachment members have male screw threads, said first and second mounting tabs having female screw threads which are complementary with the male screw threads of said first and second mounting members, said first and second holes having female screw threads which are complementary with the male screw threads of said first and second attachment members, said third and fourth holes having female screw threads which are complementary with the male screw threads of said third and fourth attachment members.

* * * * *